US009840406B2

(12) United States Patent
Santy et al.

(10) Patent No.: US 9,840,406 B2
(45) Date of Patent: Dec. 12, 2017

(54) BEVERAGE DISPENSING APPARATUS

(71) Applicant: Schroeder Industries, Inc., San Antonio, TX (US)

(72) Inventors: David Santy, Converse, TX (US); A. A. Jud Schroeder, San Antonio, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 441 days.

(21) Appl. No.: 14/461,917

(22) Filed: Aug. 18, 2014

(65) Prior Publication Data

US 2014/0346192 A1 Nov. 27, 2014

Related U.S. Application Data

(63) Continuation of application No. 12/806,800, filed on Aug. 20, 2010, now Pat. No. 8,814,003.

(60) Provisional application No. 61/287,043, filed on Dec. 16, 2009, provisional application No. 61/235,872, filed on Aug. 21, 2009.

(51) Int. Cl.

| | |
|---|---|
| ***B67D 7/06*** | (2010.01) |
| ***B67D 7/78*** | (2010.01) |
| ***B67D 7/80*** | (2010.01) |
| ***B67D 1/00*** | (2006.01) |
| ***B67D 1/08*** | (2006.01) |

(52) U.S. Cl.

CPC ..... *B67D 1/0086* (2013.01); *B67D 1/0021* (2013.01); *B67D 1/0857* (2013.01); *B67D 1/0867* (2013.01); *B67D 2001/0087* (2013.01)

(58) Field of Classification Search

CPC ..... B67D 1/07; B65D 83/34
USPC ..... 222/144.5, 148, 145.1, 146.6
See application file for complete search history.

(56) References Cited

U.S. PATENT DOCUMENTS 4,094,445 A * 6/1978 Bevan ..... B67D 1/04 141/11
4,730,463 A * 3/1988 Stanfill ..... B67D 1/0867 222/146.6

(Continued)

FOREIGN PATENT DOCUMENTS

GB 1417406 12/1972

*Primary Examiner* — Vishal Pancholi
(74) *Attorney, Agent, or Firm* — Jackson Walker, LLP

(57) ABSTRACT

A beverage dispensing apparatus is adapted to mix together a concentrate fluid with a base fluid. In certain implementations, the apparatus includes a cool fluid trunk line carrying the base fluid, a manifold, an in line and an out line extending between the cool fluid trunk and the manifold, a python and a bar gun assembly fluidly connected to the downstream side of the manifold by a plurality of conduits contained in the python, the apparatus including a recirculation channel having an inlet port and an outlet port, wherein the inlet and outlet ports of the recirculation channel are fluidly connected to respective in and out conduits in the python, the said in and out conduits being fluidly connected respectively to the in line and the out line of the cool fluid trunk line via the manifold. The beverage dispensing apparatus may further include a plurality of product lines, a mixing device, and a dispensing outlet, wherein at least one of the product lines is fluidly connected to a source of concentrate and at least one of the product lines is fluidly connected to a source of base fluid.

140 Claims, 12 Drawing Sheets

SECTION A-A

(56) References Cited

U.S. PATENT DOCUMENTS

| | | | | | |
|---|---|---|---|---|---|
| 5,042,692 | A * | 8/1991 | Valiyee | B67D 1/0084 | 222/144.5 |
| 5,190,188 | A * | 3/1993 | Credle, Jr. | B67D 1/0021 | 222/1 |
| 5,873,259 | A * | 2/1999 | Spillman | B67D 1/0867 | 222/129.1 |
| 6,341,500 | B1 * | 1/2002 | Paxman | B67D 1/0867 | 62/389 |
| 6,357,250 | B1 * | 3/2002 | Paxman | F25B 29/003 | 62/389 |
| 7,080,525 | B2 * | 7/2006 | McCann | B67D 1/0021 | 222/146.6 |
| 2001/0010318 | A1 * | 8/2001 | Saveliev | B67D 1/0006 | 222/148 |
| 2004/0217131 | A1 * | 11/2004 | McCann | B67D 1/0084 | 222/144.5 |
| 2006/0162370 | A1 * | 7/2006 | Haskayne | B67D 1/0861 | 62/390 |
| 2008/0223876 | A1 * | 9/2008 | Schroeder | B67D 1/0084 | 222/144.5 |

* cited by examiner

SECTION A-A

SECTION A - A

BEVERAGE DISPENSING APPARATUS

RELATED APPLICATIONS

This utility application is a continuation of U.S. patent application Ser. No. 12/806,800, entitled Beverage Dispensing Apparatus and filed on Aug. 20, 2010, which claims priority to U.S. Patent Application No. 61/287,043, filed on Dec. 16, 2009, and U.S. Patent Application No. 61/235,872, filed on Aug. 21, 2009. These related applications are each incorporated herein by reference.

FIELD OF THE INVENTION

Beverage dispensing systems having bar guns, more particularly, a beverage dispensing system for dispensing multiple beverages therefrom, which contains a bar gun, which bar gun has a recirculation loop for substantially continuous recirculation of cool liquids.

BACKGROUND OF THE INVENTION

This invention incorporates by reference U.S. application Ser. No. 12/286,441 entitled "A Bar Gun Assembly" filed Sep. 30, 2008 and U.S. application Ser. No. 12/465,283 entitled "Flow Control and Manifold Assembly" filed May 13, 2009.

Dispensing systems, including beverage dispensing systems having bar guns that are well-known in the art. Bar guns are designed to dispense multiple beverages therefrom, typically receiving a number of different types of syrup from a number of separate sources, as well as carbonated water. Typically, pressing a button for the desired beverage on the bar gun will valve both the carbonated water (soda) and the syrup for post-mixing and dispensing into a cup as known in the art.

Typical beverage dispensing systems of the bar gun post-mix type typically include remote vessels for the soda, which vessel is typically maintained at a cooled temperature. Trunk lines are provided from the main remote carbonated soda (out) and/or beverage syrup vessels (out), which trunk lines provide fluid under pressure to, typically, a multiplicity of remote bar guns. As is known in the art, the trunk lines carrying cooled fluid, typically soda water, carry fluid to the bar guns through a valve and manifold assembly. One of the functions of the manifold and valve assembly is to provide individual on/off valves to each of the multiplicity of lines (soda and syrup) entering the valve and manifold assembly, as well as providing individual valved channels, which valved (flow controlled) channels have valves engaged therewith. The valves may be flow control valves or mechanically set adjustable orifice valves, but in either case, they are designed to control the flow rate of the fluid (syrup or soda) flowing therethrough so as to properly mix the soda/syrup at the bar gun nozzle, so that it will be neither too strong nor too weak. All of the foregoing describes structures and functions well-known in the art.

However, prior art post-mix bar gun dispensing systems have a drawback wherein, if a long enough period of time exists between dispensing operations, fluid in the valve and manifold assembly and downstream thereof, may begin to warm up. That is to say, if a bar gun is in almost continuous use, fluid from the cooled trunk lines and remote sources is not stagnate or stationary for any period of time sufficient to warm up to or near room temperature. However, if a sufficient period of time elapses between dispensing, product (soda or syrup) in the valve and manifold assembly and downstream thereof tends to warm up. This is especially deleterious with carbonated water (soda) wherein the $CO_2$ gas entrained in the soda under pressure will release greater amounts if the dispensing temperature is warmer than if it were cooler. Greater amounts of released gas generates greater amounts of unwanted foam.

OBJECT OF THE INVENTION

It is an object of the present invention to provide for multiple means of maintaining or helping maintain a cooler temperature for liquids in the valve and manifold assembly and/or elements downstream thereof.

SUMMARY OF THE INVENTION

A beverage dispensing apparatus comprising a bar gun assembly; a valve and manifold assembly; a trunk line carrying a cool fluid and circulating through a cooler; a multiplicity of concentrate bearing lines engaging a multiplicity of concentrated sources to the upstream side of the valve and manifold assembly; a python for carrying a plurality of python fluid lines engaging the valve and manifold assembly and located between the downstream side of the valve and manifold assembly and the bar gun assembly, the python fluid lines including a multiplicity of concentrate carrying lines engaging the bar gun assembly and also including at least a valve and manifold assembly out line and a valve and manifold assembly return coolant line; an inline for carrying the cool fluid from the trunk line to the upstream side of the valve and manifold assembly and an outline carrying the cool fluid from the upstream side of the valve and manifold assembly to the trunk line; and a recirculation loop downstream of the valve and manifold assembly for engaging the out and return coolant lines of the valve and manifold assembly.

A beverage dispensing apparatus wherein the recirculation loop is located in the bar gun assembly.

A beverage dispensing apparatus wherein the recirculation loop is located in the python near the bar gun assembly.

A beverage dispensing apparatus wherein the bar gun assembly includes a heel and a handle.

A beverage dispensing apparatus wherein the recirculation loop is located in the heel of the bar gun assembly.

A beverage dispensing apparatus wherein the recirculation loop is located in the handle of the bar gun assembly.

A beverage dispensing apparatus wherein the recirculation loop includes a substantially hollow "U"-shaped member.

A beverage dispensing apparatus wherein the recirculation loop includes a substantially hollow "U"-shaped member, wherein the "U"-shaped member includes a pair of legs and a cross-piece joining the pair of legs.

A beverage dispensing apparatus wherein a first leg of the pair of legs fluidly joins the python out line and the second leg of the pair of legs joins the python inline A beverage dispensing apparatus further including means to assist in fluidly engaging the pair of legs to the two python lines.

A beverage dispensing apparatus further including a bypass line for carrying cool fluid past the valve and manifold assembly without engaging the same.

A beverage dispensing apparatus wherein the recirculation loop is located in the bar gun assembly.

A beverage dispensing apparatus wherein the recirculation loop is located in the python near the bar gun assembly.

A beverage dispensing apparatus wherein the bar gun assembly includes a heel and a handle.

A beverage dispensing apparatus wherein the recirculation loop is located in the heel of the bar gun assembly.

A beverage dispensing apparatus wherein the recirculation loop is located in the handle of the bar gun assembly.

A beverage dispensing apparatus wherein the python includes insulation near the recirculation loop.

A beverage dispensing apparatus wherein the bar gun assembly includes insulation near the recirculation loop.

A beverage dispensing apparatus comprising a bar gun assembly; a valve and manifold assembly; a trunk line carrying a cool fluid and circulating through a cooler; a multiplicity of concentrate bearing lines engaging a multiplicity of concentrated sources to the upstream side of the valve and manifold assembly; a python for carrying a plurality of fluid lines engaging the valve and manifold assembly and located between the downstream side of the valve and manifold assembly and the bar gun assembly, including a multiplicity of concentrate carrying lines engaging the bar gun assembly and also including at least a valve and manifold assembly out line and a valve and manifold assembly return coolant line; an inline for carrying the cool fluid from the trunk line to the upstream side of the valve and manifold assembly and an outline carrying the cool fluid from the upstream side of the valve and manifold assembly to the trunk line; a recirculation loop downstream of the valve and manifold assembly for engaging the out and return coolant lines of the valve and manifold assembly; and further including a bypass line for carrying cool fluid past the valve and manifold assembly.

A beverage dispensing apparatus of wherein the python includes insulation near the recirculation loop.

A beverage dispensing apparatus wherein the bar gun assembly includes insulation near the recirculation loop.

A beverage dispensing apparatus wherein the bar gun assembly includes a heel and a handle.

A beverage dispensing apparatus wherein the recirculation loop is located in the heel of the bar gun assembly.

A beverage dispensing apparatus wherein the recirculation loop is located in the handle of the bar gun assembly.

A beverage dispensing apparatus further including insulation adjacent the recirculation loop.

A beverage dispensing apparatus further including insulation adjacent the recirculation loop.

A beverage dispensing apparatus comprising a bar gun assembly; a valve and manifold assembly; a trunk line carrying a cool fluid and circulating through a cooler; a multiplicity of concentrate bearing lines engaging a multiplicity of concentrated sources to the upstream side of the valve and manifold assembly; a python for carrying a plurality of python fluid lines engaging the valve and manifold assembly and located between the downstream side of the valve and manifold assembly and the bar gun assembly, the python fluid lines including a multiplicity of concentrate carrying lines engaging the bar gun assembly and also including at least a valve and manifold assembly out line and a valve and manifold assembly return coolant line; an inline for carrying the cool fluid from the trunk line to the upstream side of the valve and manifold assembly and an outline carrying the cool fluid from the upstream side of the valve and manifold assembly to the trunk line; and a recirculation loop downstream of the valve and manifold assembly for engaging the out and return coolant lines of the valve and manifold assembly; wherein the recirculation loop is located in the bar gun assembly; wherein the bar gun assembly includes insulation near the recirculation loop.

A beverage dispensing apparatus wherein the bar gun assembly includes a heel and a handle.

A beverage dispensing apparatus wherein the recirculation loop is located in the heel of the bar gun assembly.

A beverage dispensing system comprising a multiplicity of assemblies, each of the multiplicity of assembles engaging a trunk line carrying a cool fluid and circulating through a cooler, each assembly of the multiplicity of assemblies including; a bar gun assembly; a valve and manifold assembly; a multiplicity of concentrate bearing lines engaging a multiplicity of concentrated sources to the upstream side of the valve and manifold assembly; a python for carrying a plurality of python fluid lines engaging the valve and manifold assembly and located between the downstream side of the valve and manifold assembly and the bar gun assembly, the python fluid lines including a multiplicity of concentrate carrying lines engaging the bar gun assembly and also including at least a valve and manifold assembly out line and a valve and manifold assembly return coolant line; an inline for carrying the cool fluid from the trunk line to the upstream side of the valve and manifold assembly and an outline carrying the cool fluid from the upstream side of the valve and manifold assembly to the trunk line; and recirculation loop downstream of the valve and manifold assembly for engaging the out and return coolant lines of the valve and manifold assembly and further including a bypass line for carrying cool fluid past the valve and manifold assembly without engaging the same.

A beverage dispensing system of Claim 30 wherein the recirculation loop is located in the bar gun assembly.

A beverage dispensing system of Claim 30 wherein the recirculation loop is located in the python near the bar gun assembly.

A beverage dispensing system of Claim 30 wherein the bar gun assembly includes a heel and a handle.

A beverage dispensing system of Claim 33 wherein the recirculation loop is located in the heel of the bar gun assembly.

A beverage dispensing system of Claim 33 wherein the recirculation loop is located in the handle of the bar gun assembly.

A beverage dispensing system of Claim 34 wherein the recirculation loop includes a substantially hollow "U"-shaped member; and insulation near the recirculation loop.

A beverage dispensing system of Claim 1 further including a splitter for carrying the coolant therethrough, and wherein one of the python lines is adapted to engage, via the valve and manifold assembly, the splitter, for carrying cooling fluid therein to the bar gun assembly for dispensing therefrom.

A beverage dispensing system of Claim 18 further including a splitter for carrying the coolant therethrough, and wherein one of the python lines is adapted to engage, via the valve and manifold assembly, the splitter, for carrying cooling fluid to the bar gun assembly for dispensing therefrom.

A beverage dispensing system of Claim 27 further including a splitter for carrying the coolant therethrough, and wherein one of the python lines is adapted to engage, via the valve and manifold assembly, the splitter, for carrying cooling fluid to the bar gun assembly for dispensing therefrom.

A beverage dispensing system of Claim 30 further including a splitter for carrying coolant therethrough, and wherein one of the python lines is adapted to engage, via the valve and manifold assembly, the splitter, for dispensing cooling fluid therefrom.

One feature is a recirculation loop, which recirculates coolant (typically carbonated water or water), from the cool trunk line carrying the coolant through the valve and manifold assembly, then through the python and into the bar gun, returning (undispensed) back through the python and through the valve and manifold assembly into the trunk line. This recirculation loop is operational even when the bar gun is not in use. That is to say, the recirculation loop will recirculate coolant from the trunk line through the python and valve assembly into the coolant trunk line. This recirculation loop is valved for flow even when the bar gun is not in use (that is to say, when none of the buttons on the bar gun are actively dispensing fluid therefrom). The recirculation loop may be situated in the bar gun handle, in the heel or in the python, where it would typically be situated proximate the bar gun handle.

Regarding the recirculation feature, it is noted that the structure providing recirculation, generally a U-shaped member, will direct fluid from a direction towards the dispensing nozzle to a direction away from a dispensing nozzle and back towards the valve and manifold assembly. In regards to the location of this structure that will redirect the cooling fluid, it may be located in the bar gun handle itself, in one embodiment, and in a second embodiment, may be located in the heel of the apparatus, or it may be located in the python. In all of these cases, the structure of the recirculation loop is downstream of the valve and manifold assembly. This is unlike the prior art in which it is known to deliver cooling fluid up to, but not into, the valve and manifold assembly.

Another feature of the recirculation loop is that it may be open or closed. In an open recirculation loop the cool fluid may be drawn off and mixed with syrup and dispensed as product into a cup for a consumer. Clearly, in an open system, the cooling fluid is compatible with the beverage and may be drunk by the consumer. Typically, an open system would use cooled soda water. In a closed system, there is no structure or function providing for the drawing off of cooling fluid to dispense into a container. In the case of a closed system, there are more options for the cooled fluid, and fluids such as glycol or the like may be used. There is no need to worry, in a closed system, about the compatibility of the cooled fluid for human consumption.

A third feature, which may be used alone or in combination with the recirculation loop, is the providing of insulation in various parts of the valve and manifold assembly and/or the python or the bar gun of the bar gun assembly. This insulation will help prevent heat loss by radiation, conduction and/or convection from the fluid in the valve and manifold assembly and/or the sheath and may assist in the transfer of heat between the coolant fluid and the uncooled fluids carried by respective conduits in the python. Insulation, in one example a pocket of air adjacent the recirculation loop, may help avoid the excessive cooling of the exterior of the bar gun body. Excessive cooling of a bar gun resting unused over a period of time, while good for the first dispensing of a cool drink, may cause the bar gun surface to form condensation thereon, as "sweat."

The position of the recirculation loop in the apparatus, for example as in the heel or python, will help prevent "sweating" of the bar gun body. The use of insulation will also help prevent "sweating" of the bar gun body.

Preferably, the recirculation loop is used in conjunction with the insulation to provide for effective prevention of heat loss from the liquids of the bar gun assembly and/or sweating of the bar gun body.

BRIEF DESCRIPTION OF THE DRAWINGS

FIGS. 4A and 4B show the U-shape fitting exploded away from lines 50 and 52, while FIG. 4C shows the fitting as it is used, attached to the removed ends of lines 50 and 52.

DETAILED DESCRIPTION OF THE PREFERRED EMBODIMENT

Figure 1A:
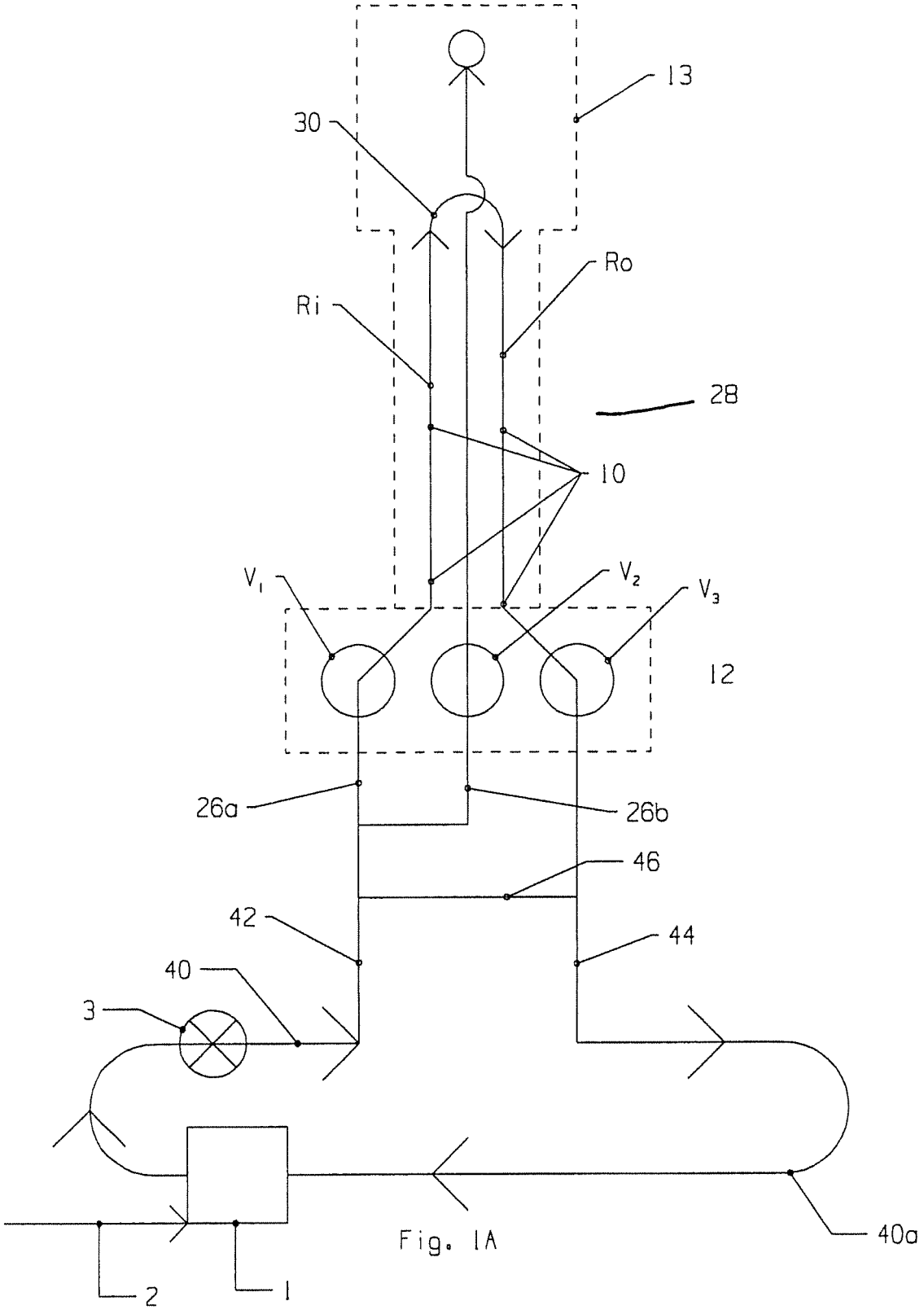
FIG. 1A is a schematic illustration of the elements of a recirculation loop of the bar gun system.
Figure 1B:
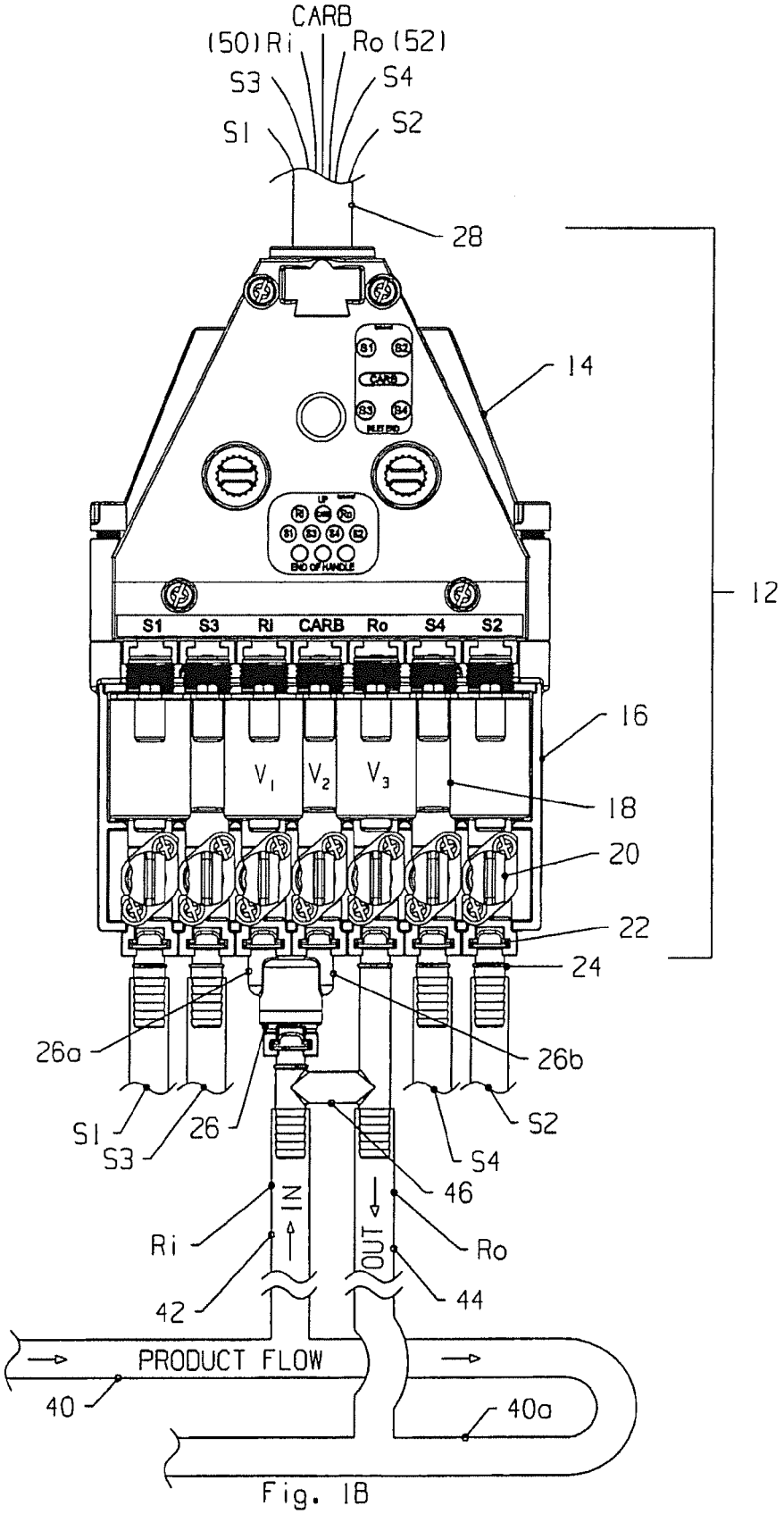
FIG. 1B is a top elevational view of the elements of the recirculation loop as they apply to the trunk line, valve and manifold assembly, and python.

FIGS. 1A, 1B, and 10 illustrate various elements, structurally and functionally, of beverage dispensing apparatus that may comprise Applicants' recirculation loop 10. As stated above, the recirculation loop 10 is designed to help prevent heat loss in the valve and manifold assembly and the elements downstream thereof, including the python and bar gun assembly 13.

Figure 1C:
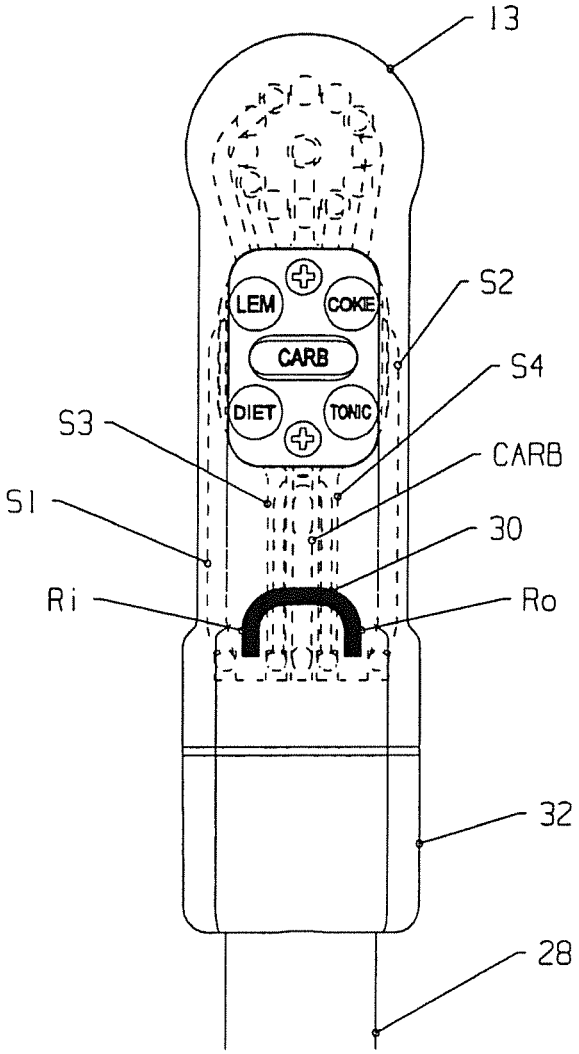
FIG. 1C is a top elevational view of the bar gun illustrating the recirculation channel therein.

This function is achieved through the use of an in line 42 carrying incoming cool fluid Ri coming off trunk line 40 entering and passing through valve/manifold assembly 12 and into the bar gun assembly 13 in conjunction with a recirculation channel 30, which in the illustrated example is in the bar gun assembly 13, and which joins recirculation in line Ri to recirculation out line Ro in the bar gun handle as illustrated in FIG. 1C. Ro then exits bar gun assembly 13, passes through a line situated in python 28, through valve/manifold assembly 12, to out line 44, and into a trunk line return 40*a* (for coolant recirculation). The embodiment illustrated in FIGS. 1A and 1B is an open system where the recirculating cool fluid is a fluid that may be dispensed through the bar gun. Suitable fluids include, but are not limited to: soda water, carbonated water, water, consumable liquefied gases, or consumable gaseous fluids such as carbon dioxide, which when mixed with the other liquids in the bar gun carbonates the dispensed beverage. When referring to consumable liquefied gases and consumable gaseous fluids the Applicant is referring to such gases and fluids which are known to be consumable in certain proportions by human beings without harm.

Additional elements may be seen with reference to FIGS. 1A-1C. More particularly, in line 42 may take recirculation fluid Ri into a splitter 26 having branch 26*a* and branch 26*b*. Recirculation fluid Ri will pass through V1 and as dispensed coolant, typically carbonated water through V2, which are two of a multiplicity of valves 18. Valves 18 may be of the flow control type or adjustable/fixed orifice type, but in any case are valves known in the art to control the flow of fluids therethrough. In conjunction with a multiplicity of valves 18 (engaged with channels therethrough) may be shutoff or ball valves 20 as known in the art.

It is not necessary that all the coolant passing through in line 42 should pass through the recirculation channel 30. A bypass line 46 may extend between the in line 42 and the out line 44. Hence, whilst some of the coolant passes through the recirculation channel 30, some of the coolant passes directly into the out line, without passing through the recirculation channel 30. The relative proportion of coolant passing through the recirculation channel 30 and the bypass line 46 maybe influenced by the setting of valves V1 and V3, the relative sizes of the in line 42, out line 44 and bypass line 46 for example.

At splitter 26, recirculation fluid (coolant) passing through branch 26*a* will be destined to return through V3 and out line 44 as Ro (recirculation of the fluid out). When the bar gun is not being used, that is, none of the beverages are being dispensed, then it may be seen that substantially no flow will occur through branch 26*b*, valve V2, and the line marked "carb" (for carbonated water or soda water). That is to say, the recirculation loop operates primarily in a mode in which none of the buttons (actuating valves as known in the art) of the bar gun are being depressed and no beverage is being dispensed. In such a condition, recirculating fluid Ri will circulate in the channels and lines as illustrated up to recirculation channel 30 where it will perform a substantial "U-turn" and return as recirculation out or Ro through line 44 and into the trunk return line 40*a*. The trunk line typically carries chilled carbonated fluid and thus has an out line 40 which services a number of bar gun assemblies 13 (see FIG. 1F) and a return line 40*a* engaging a source 1 of carbonated water or soda cooled by a chiller 1 as known in the art and including a recirculation pump 3 as known in the art. Valves V1 and/or V3 may be adjusted to control the flow rate of recirculation fluid therethrough. Indeed, valves V1 and V3 may be used, but it is not necessary that they are adjusted—the recirculation fluid may flow through valves V1 and V3 with the valves open. Indeed, valves V1 and V3 may be no more than openings of a specified size to give a desired flow rate with no facility to adjust for adjustment to control the flow rate. Valve V2, where such a valve is adjustable to control the flow of fluid flowing therethrough, may be adjusted to control said flow of the fluid. A splitter is not necessary to the recirculation loop, line 42 may go directly into the fitting that, in illustration FIG. 1A, engages branch 26*a* and the fitting engaging branch 26*b* will receive the product from the trunk line as known in the art. Such an arrangement also provides for a closed system where the coolant fluid is not used in the mixing of beverages. Such coolant fluid could be ethylene glycol or another known refrigerant.

Figure 1D:
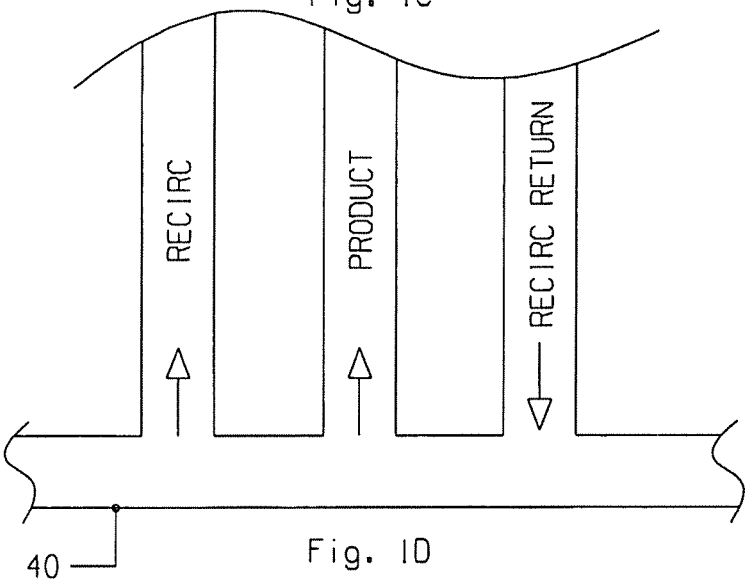
FIG. 1D is an alternate configuration of lines carrying fluid to the valve and manifold assembly.
Figure 1E:
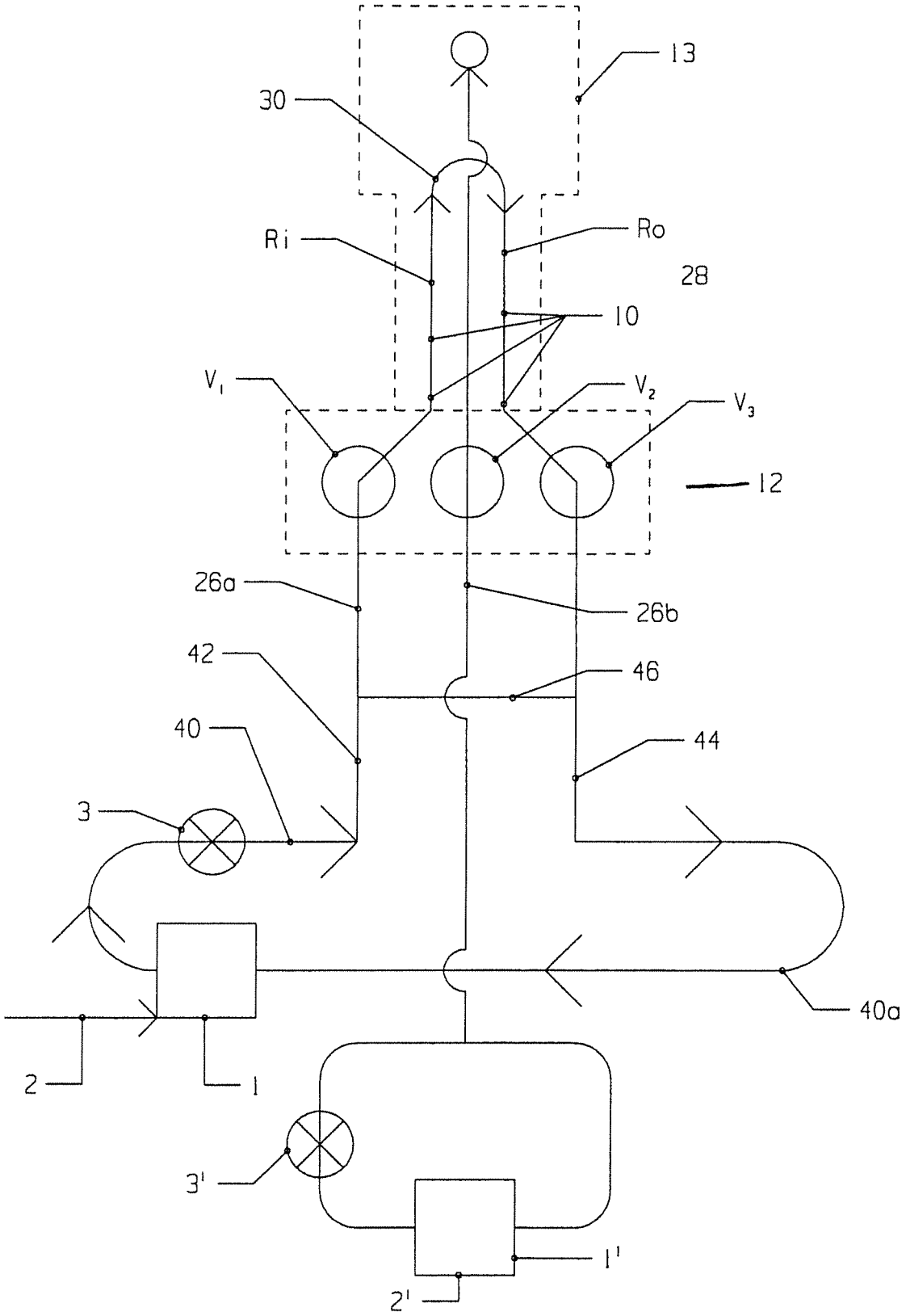
FIG. 1E illustrates a closed system.
Figure 1F:
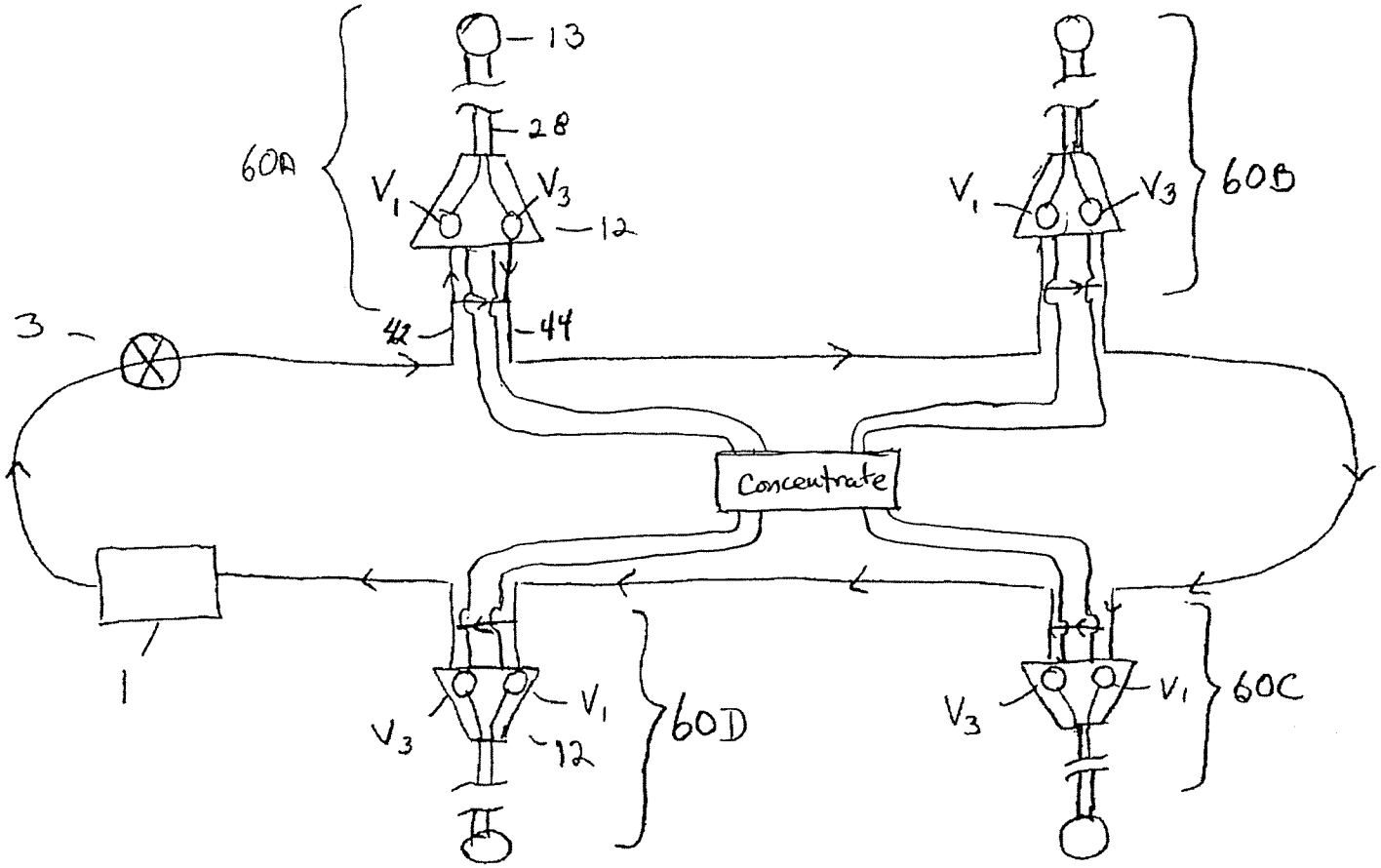
FIG. 1F is a schematic illustration of a beverage dispensing system comprising multiple beverage dispensing apparatus operating off a common coolant line.

FIG. 1F illustrates multiple (four) flow control/python/bar gun assembly systems 60A/60B/60C/60D. Each is comprised of at least elements 12/13/28/42/44/46/V1/V3. That is to say, coming off the trunk line or coolant main line, the system 60A/60B/60C/60D comprising a flow control/python/bar gun assembly is typically provided at multiple places.

It is seen that adjusting either V1 or V3 at 60A will affect the crossover or bypass coolant fluid going through 46 and back into the main coolant line. Specifically, either V1 or V3 may be adjusted to choke down or reduce the flow of coolant therethrough and therefore to the recirculation loop of the python and/or bar gun assemblies. Then, more of that fluid will go through line 46 and be available as fluid typically a little bit cooler than the fluid that went through the python 28 of 60A. Increasing the flow of fluid through python 28 of 60A will provide a cooler temperature at the elements downstream of 46 on 60A, but will provide a slightly higher temperature to downstream elements 60B/60C/60D.

Thus, it is seen that by adjusting either or both of valves V1 or V3 at each of the stations, the amount of cool fluid going into the recirculation loops at each station can be controlled and the flow to the recirculation loop can be increased for more coolant or decreased. However, it is also recognized that increased flow at any recirculation loop will slightly decrease the ability for downstream stations (for example, station 60B/60C/60D which are downstream from 60A) to cool themselves.

A number of the other elements illustrated in FIGS. 1A-1C are known in the art. Locking slides 22 and fittings 24 removably engage a number of typically flexible fluid lines to the valve and manifold assembly 12. Pythons 28 are known in the art and include outer sheath 34 and carry a number of fluid bearing lines therethrough, here four syrup lines and a carb line. However, the python of the present invention is also carrying a line for recirculation fluid Ri designated 50 and a line for Ro designated 52 as illustrated. Lines 50 and 52 originate at the manifold assembly, run through the python, and in one embodiment engage recirculation channel 30, and in a second embodiment (FIGS. 4A-4C) engage a "U" shaped fitting 54 outside of bar gun body 13A. Both a "U" shaped fitting 54 and the recirculation channel 30 will signify a structural member or element adapted to reverse the flow of coolant from towards the dispensing nozzle to away from the dispensing nozzle.

Additional features of Applicants' present device are also provided in an effort to achieve a reduction of heat loss to the environment from the fluids in the lines and valves and other elements of the valve and manifold assembly, python and/or bar gun assembly.

Figure 2A:
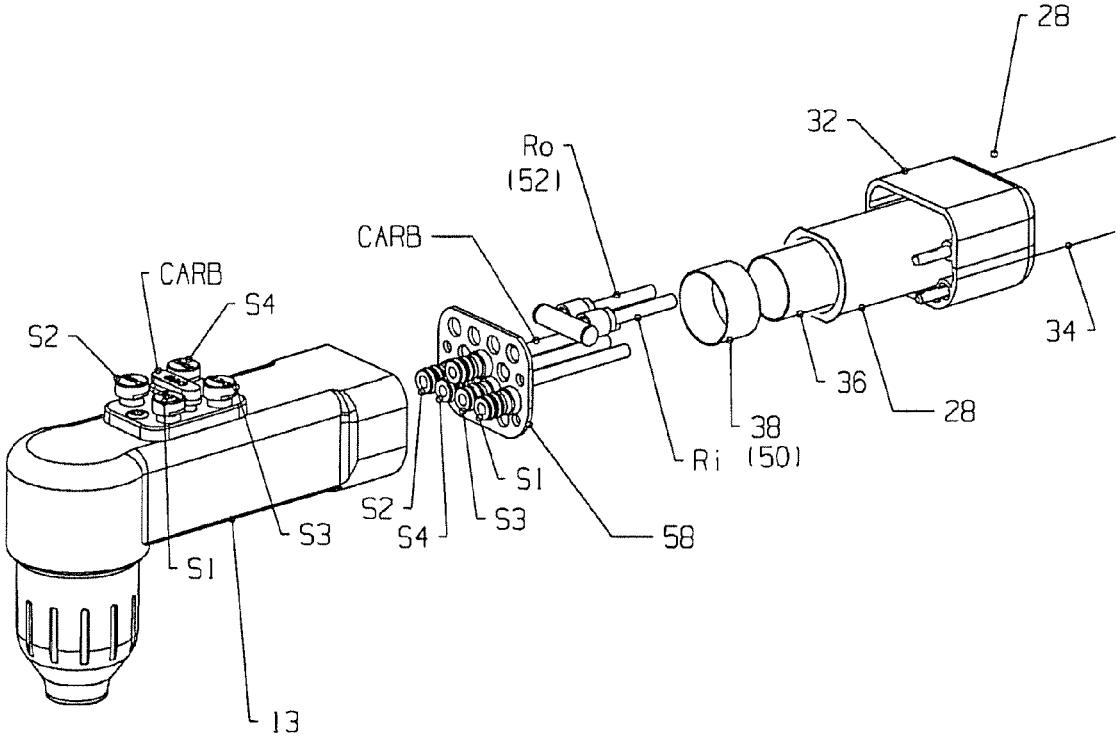
FIG. 2A is a perspective view of the manner in which the python joins the bar gun illustrating details of the insulation used as well as the arrangement of the lines incorporating the recirculation loop.
Figure 2B:
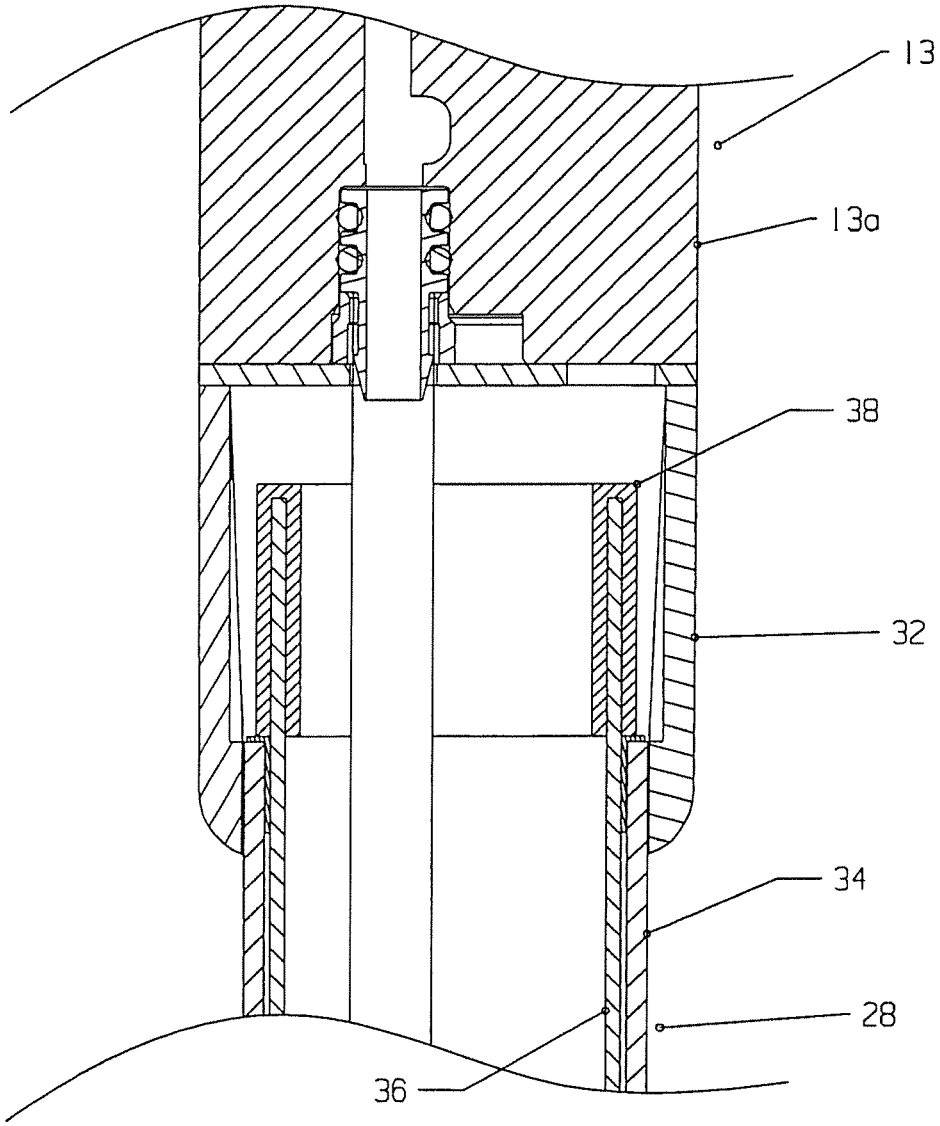
FIG. 2B is a cross-section elevational view of some of the elements illustrated in FIG. 2A.

An additional feature includes the use of insulation including, typically, tubular insulation at least partially within python 28 as illustrated in FIGS. 2A and 2B. That is to say, python 28 may, in addition to having outer sheath 34, carry insulation 36, which may be tubular and which may be located within or on the outside of outer sheath 34 (illustrated is an inner python sheath insulation 36). In the manner illustrated, insulation preferably wraps or at least partially wraps the multiplicity of lines within the python, including Ri and Ro, those lines carrying the recirculated fluid (coolant). The sheath 34 may be combined with sheath insulation 36 as a single unit combining flexibility, insulation and an annulus or channel therethrough. As can be seen in FIG. 2A, python insulation sheath 30 may extend slightly beyond outer sheath 34 (upstream end) and may be wrapped with an insulated tape 38 to help protect and further insulate the lines within the python and extending past the python into body 13A of the bar gun. Tape 38 may be an insulation type tape (preferably adhesive bearing) and may help prevent chafing of the lines. The insulation 36 may in addition to preventing heat loss may also increase heat transfer between conduits carrying cooled fluid and those carrying uncooled fluid by bringing them into closer proximity. The fluid carrying lines and the insulation 36, 38 may be so shaped and dimensioned as to squeeze together (but not crush) fluid carrying conduits so that heat exchange between adjacent conduits is at least partially by conduction.

Figure 2C:
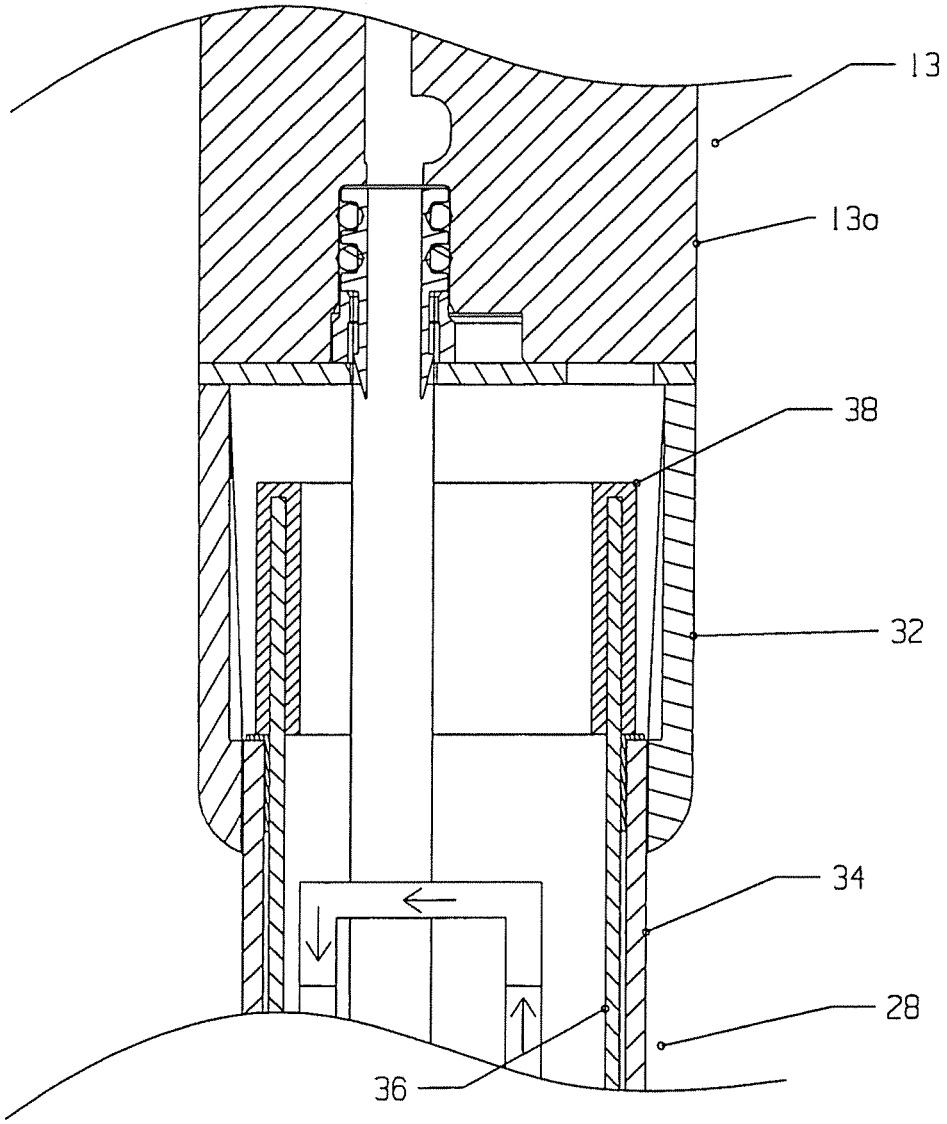
FIG. 2C is a cross-section elevational view of the elements illustrated in FIG. 2A where a recirculation channel is situated in the python proximate the heel of the bar gun assembly.

Referring to FIG. 2C the parts illustrated are essentially the same as shown in FIG. 2*b*, except that the recirculation channel 30 is situated in the python proximate the heel 32 of the bar gun assembly.

Figure 3:
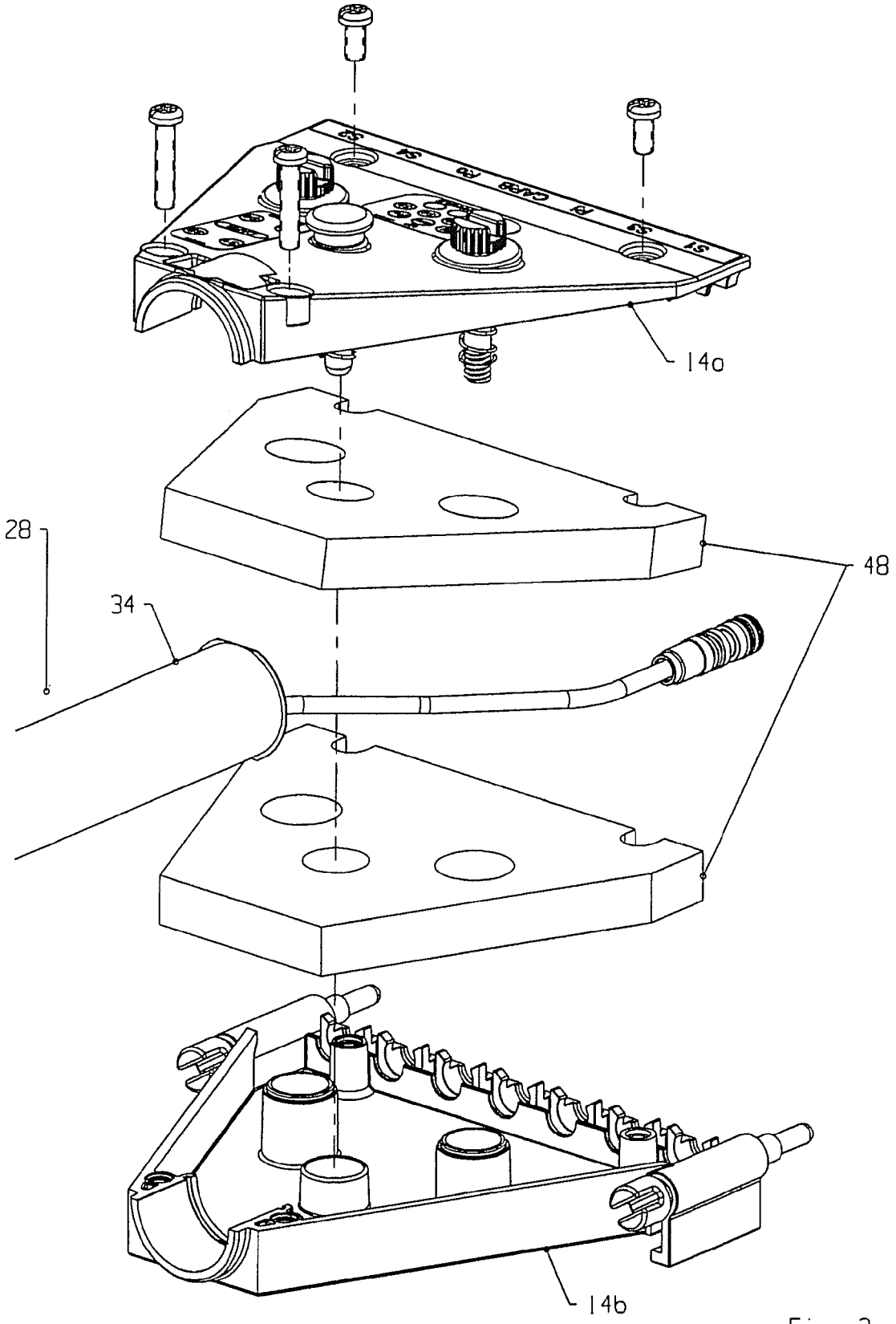
FIG. 3 is an exploded perspective view of the manifold portion of the valve and manifold assembly illustrating the manner in which insulation is used therewith and the manner in which it joins the python.

Turning to FIG. 3, it may be seen that manifold insulation 48 may be used in conjunction with any of the other elements of Applicants' design. More particularly, FIG. 3. illustrates the use of manifold insulation at least partially within manifold covers 14*a*/14*b*, which covers comprise a manifold housing. Manifold insulation 48 may be internal, that is to say, within the housing and may at least partially rest adjacent the multiplicity of lines passing through the manifold from the valve assembly 16 to manifold 14 into python 28.

FIG. 1D illustrates alternative embodiments for bringing cool recirculation fluid and product (or multiple products) to the valve and manifold assembly from a source. The recirculation fluid used will be chilled, before entering the recirculation loop, product dispensed may or may not be. Types of insulation that may be used include, but are not limited to, foam, armaflex, fiberglass, flat, tubular tape, etc. Where the product dispensed for example syrup is not cooled, this product may be delivered via a fluid line other than trunk line 40 in ways known in the art.

FIG. 1E illustrates an alternative embodiment where a separate supply of product 2' is delivered to the bar gun assembly 13 by a pump 3' from a chiller 1'. Such an arrangement provides for a closed system as described above.

Recirculation fluid passing through branch 26*a* and V1 as Ri will be destined to return through V3 and out line 44 as Ro (recirculation of the fluid out). When the bar gun is not being used, that is, none of the beverages are being dispensed, then it may be seen that substantially no flow will occur through branch 26*b*, valve V2. In this embodiment, the recirculation loop operates in the same manner whether buttons to dispense beverage are actuated or not, i.e. whether product flows through branch 26*b* or not. Recirculating fluid Ri will circulate in the channels and lines as illustrated up to recirculation channel 30 where it will perform a substantial "U-turn" and return as recirculation out or Ro through line 44 and into the trunk return line 40*a*. In this example, the trunk line typically carries glycol or the like and has an out line 40 which services a number of bar gun assemblies 13 and a return line 40*a* engaging a source of glycol 2 cooled by a chiller 1 as known in the art and including a recirculation pump 3 as known in the art. Valves V1 and/or V3 may be adjusted to control the flow rate of recirculation fluid therethrough. Indeed, valves V1 and V3 may be used, but are not necessary—the recirculation fluid may flow unvalved. Valve V2 may be adjusted to control flow of the product flowing therethrough.

Figure 4A:
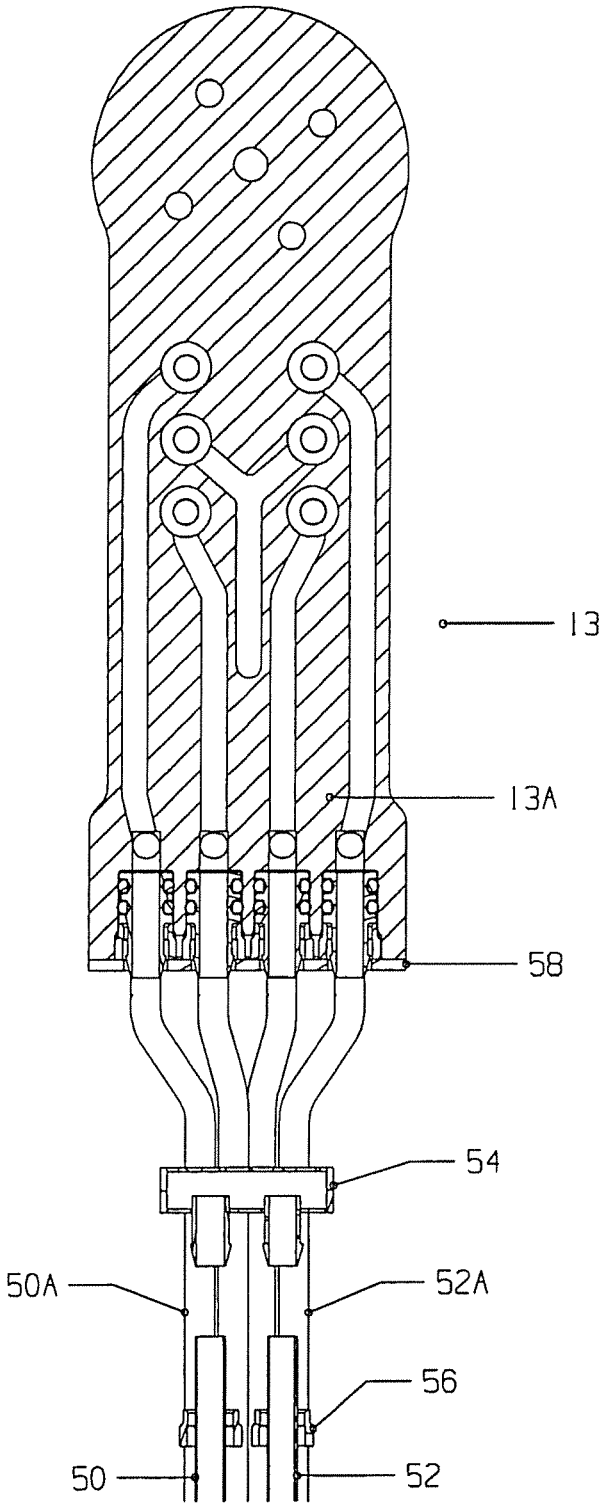
FIGS. 4A, 4B, and 4C are illustrations of an alternate preferred embodiment of Applicant's recirculation loop.
Figure 4B:
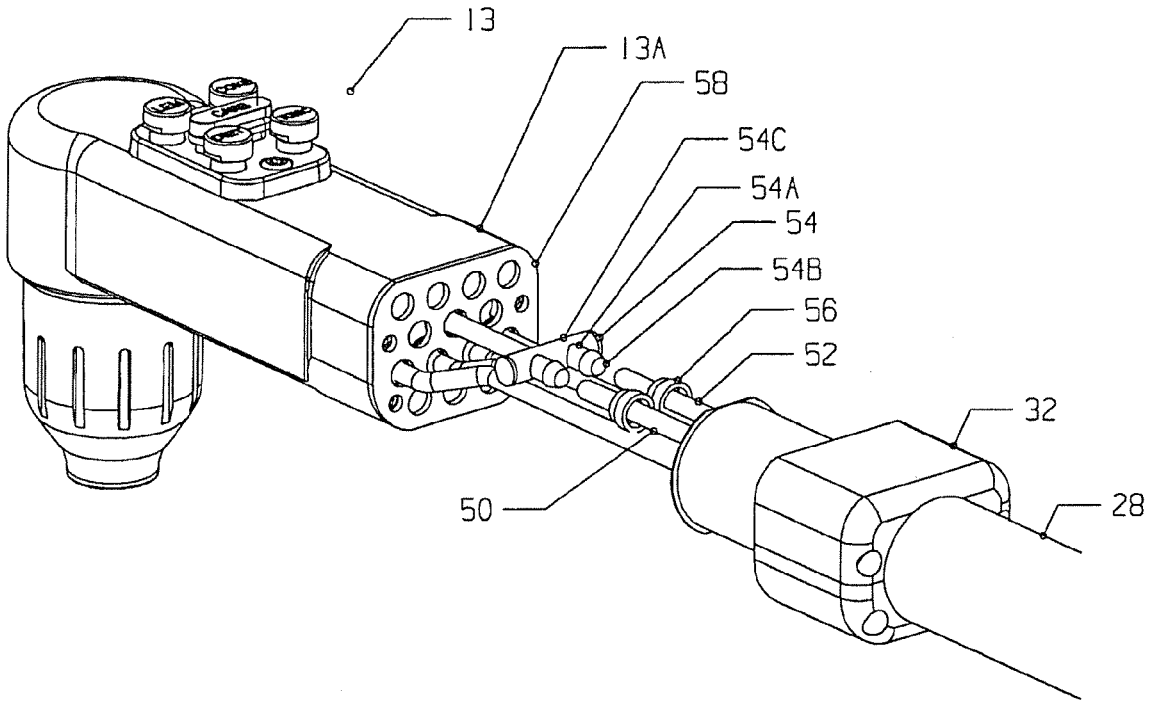
Figure 4C:
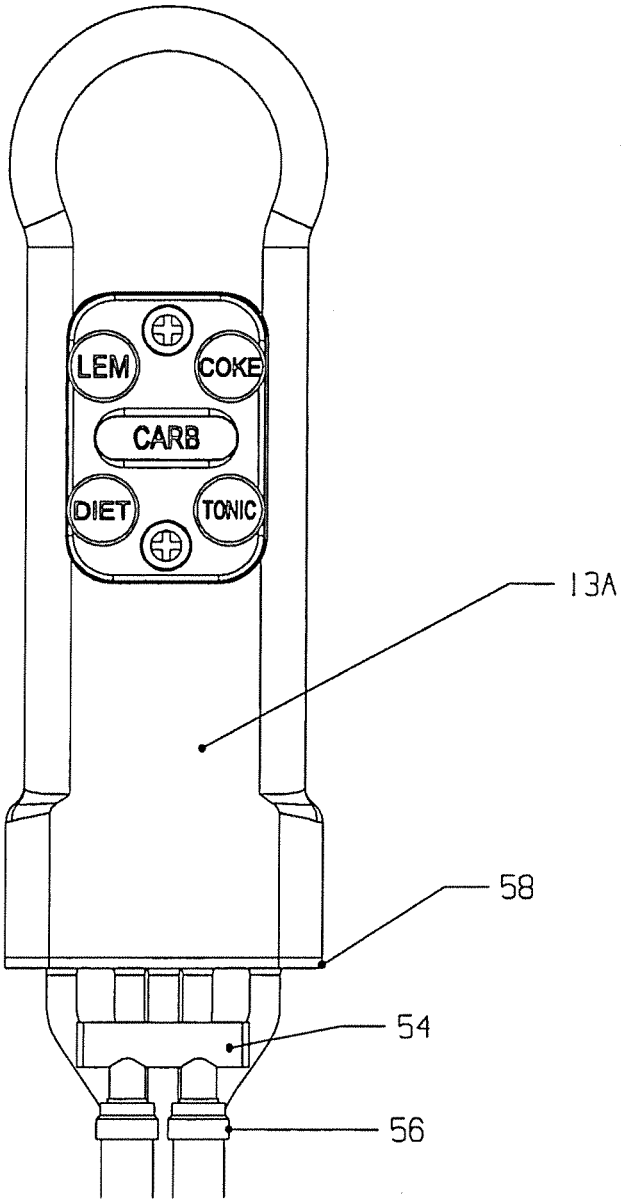

FIGS. 4A, 4B, and 4C illustrate an alternate preferred embodiment from that described above and as set forth in the previous Figures. In the alternate preferred embodiment, the rerouting or reversal of the incoming fluid Ri to the outgoing fluid Ro occurs not in bar gun body 13A, like described above.

As can be seen from FIGS. 4A-4C, U-shape fitting 54 typically engages the removed ends of lines 50 and 52 between the heel 32 of the bar gun assembly and the removed end of the sheath. That is to say, U-shape fitting 54 engages the removed ends 50*a*/52*a* in a fluid sealing fashion and when heel 32 is attached, through fasteners to the rear of body 13A of the bar gun assembly, U-shape fitting 54 is typically located substantially in the space just beyond the end of python 28 and the mounting plate 58. FIG. 4C shows the fitting attached, as in use (but for clarity deletes heel, insulation, and python). With the U-shape fitting 54 mounted as illustrated in FIGS. 4A-4C, when assembled the U-shape fitting is covered by heel 32.

U-shape fitting 54 is substantially hollow and incoming fluid from line 50 enters the leg attached to line 50 and passes through body 54*c*, and into line 52. In other words, U-shape fitting 54 recirculates incoming fluid from line 50 to line 52 as outgoing fluid Ro. Moreover, this recirculation occurs without the recirculation fluid (typically cool fluid recirculating at times when the bar gun is not in use) entering body 13A of the bar gun assembly. Moreover, the insulation (tape, foam or other suitable insulation) that is illustrated as used with the sheath can be used to at least partially cover U-shape fitting 54. In this fashion, with the coolant fluid avoiding contact with the bar gun body itself, the problem of bar gun "sweating" is avoided. With the embodiment of the previous illustration, wherein the recirculation fluid actually enters body 13A of the bar gun assembly, there has been some experience where the bar gun assembly is left overnight, for instance, "sweats" at the portion of the bar gun that is adjacent the recirculation channel. The use of the U-shape fitting upstream of the bar gun body as illustrated is one method of avoiding the "sweating" issue.

Thus, it is seen that the construction of U-shape fitting 54 having hollow legs 54*a* with barbs 54*b* at the removed end thereof and having hollow body 54*c* would provide for snug fit of ends 50*a* and 52*a* over barbs 54*b*. Moreover, it can be seen that slidable, flexible collars 56 may, after the ends of lines 50 and 52 are engaged to legs 54*a*, be moved up and to partially engage the outside of ends 50*a* and 52*a* and, optionally, part of legs 54*a* to provide a snug, slip-resistant fitting of lines 50 and 52 to U-shape fitting 54.

In another embodiment of the invention, instead of the U-shape fitting 54 being situated just outside the end of the outer sheath 34 of the python 28, the u-shape fitting may be situated within the sheath 34, preferably proximate the end thereof which attaches to the bar gun assembly.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. A beverage dispensing apparatus comprising:

a bar gun assembly;

a valve and manifold assembly, the assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line;

a bypass line located upstream of the first port and downstream of the second port, the bypass line diverting at least some of the liquid coolant away from the first port so that at least some of the coolant does not pass through the valve and manifold assembly; and a recirculation loop between the valve and manifold assembly and the bar gun assembly, the recirculation loop engaging the out and return liquid coolant lines of the valve and manifold assembly and adapted to route liquid coolant from the liquid coolant out line to the liquid coolant return line while maintaining the liquid coolant in a substantially liquid phase.

2. The beverage dispensing apparatus of claim 1 wherein the recirculation loop is located in the bar gun assembly.

3. The beverage dispensing apparatus of claim 1 wherein the recirculation loop is located in the python near the bar gun assembly.

4. The beverage dispensing apparatus of claim 1 wherein the bar gun assembly includes a heel and a handle, and the recirculation loop is located in the heel of the bar gun assembly.

5. The beverage dispensing apparatus of claim 1 wherein the recirculation loop includes a substantially hollow "U"-shaped member adapted to route liquid coolant from the liquid coolant out line to the liquid coolant return line while maintaining the liquid coolant in a substantially liquid phase.

6. The beverage dispensing apparatus of claim 5 wherein the "U"-shaped member includes a pair of legs and a cross-piece joining the pair of legs, wherein a first leg of the pair of legs fluidly joins the out line and the second leg of the pair of legs fluidly joins the return line.

7. The beverage dispensing apparatus of claim 1 wherein the recirculation loop is located in the bar gun assembly.

8. The beverage dispensing apparatus of claim 1 wherein the recirculation loop is located in the python near the bar gun assembly.

9. The beverage dispensing apparatus of claim 7 wherein the bar gun assembly includes a heel and a handle, and the recirculation loop is located in the heel of the bar gun assembly.

10. The beverage dispensing apparatus of claim 1 wherein the valve and manifold assembly is adapted to provide flow control to the liquid coolant being received at the first port.

11. The beverage dispensing apparatus of claim 1 further comprising:

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line for carrying liquid coolant from the trunk line to the first port of the valve and manifold assembly; and an out line carrying liquid coolant from the second port of the valve and manifold assembly to the trunk line.

12. The beverage dispensing apparatus of claim 1 wherein the python includes an outer sheath substantially enclosing the python fluid lines therein.

13. The beverage dispensing apparatus of claim 1 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

14. A beverage dispensing apparatus comprising:

a bar gun assembly;

a valve and manifold assembly, the assembly including:

a first port to receive liquid coolant from a source, a second port to emit the liquid coolant back towards the source, a multiplicity of ports to receive beverage concentrates, and a multiplicity of flow control elements for controlling the flow of fluid therethrough;

a python for carrying a plurality of fluid lines adapted to engage a valve and manifold assembly and extending towards the bar gun assembly, the fluid lines including a multiplicity of beverage concentrate carrying lines engaging the bar gun assembly and also including at least a liquid coolant in line and a liquid coolant return line;

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line; and a recirculation loop downstream of the liquid coolant in line for engaging the in and return liquid coolant lines, the recirculation loop adapted to route liquid coolant from the liquid coolant in line to the liquid coolant return line while maintaining the liquid coolant in a substantially liquid phase.

15. The beverage dispensing apparatus of claim 14 wherein the recirculation loop is located in the bar gun assembly.

16. The beverage dispensing apparatus of claim 14 wherein the recirculation loop is located in the python near the bar gun assembly.

17. The beverage dispensing apparatus of claim 14 wherein the bar gun assembly includes a heel and a handle, and the recirculation loop is located in the heel of the bar gun assembly.

18. The beverage dispensing apparatus of claim 14 wherein the recirculation loop includes a substantially hollow "U"-shaped member adapted to route liquid coolant from the liquid coolant in line to the liquid coolant return line while maintaining the liquid coolant in a substantially liquid phase.

19. The beverage dispensing apparatus of claim 18 wherein the "U"-shaped member includes a pair of legs and a cross-piece joining the pair of legs, wherein a first leg of the pair of legs fluidly joins the in line and the second leg of the pair of legs fluidly joins the return line.

20. The beverage dispensing apparatus of claim 14 wherein the valve and manifold assembly is adapted to provide flow control to the liquid coolant being received at the first port.

21. The beverage dispensing apparatus of claim 14 further including a bypass line located upstream of the first port and downstream of the second port, the bypass line diverting at least some of the liquid coolant away from the first port so that at least some of the coolant does not pass through the valve and manifold assembly.

22. The beverage dispensing apparatus of claim 14 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

23. The beverage dispensing apparatus of claim 14 wherein the python includes an outer sheath for substantially enclosing the python fluid lines therein.

24. A beverage dispensing apparatus comprising:

a valve and manifold assembly, the assembly including:

a first port to receive a liquid coolant from a source, a second port to emit the liquid coolant into a python fluid line, a third port to receive the liquid coolant from a python fluid line, a fourth port to emit the liquid coolant back towards the source, and a multiplicity of ports to receive beverage concentrates, and a multiplicity of flow control elements for controlling the flow of fluid therethrough; and a bypass line located upstream of the first port and downstream of the second port, the bypass line diverting at least some of the liquid coolant so that at least some of the liquid coolant does not pass through the valve and manifold assembly.

25. The beverage dispensing apparatus of claim 24, further comprising:

a bar gun assembly;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line; and a recirculation loop between the valve and manifold assembly and the bar gun assembly, the recirculation loop engaging the out and return liquid coolant lines of the valve and manifold assembly and adapted to route the liquid coolant from the liquid coolant out line to the liquid coolant return line while maintaining the liquid coolant in a substantially liquid phase.

26. The beverage dispensing apparatus of claim 25 wherein the recirculation loop is located in the bar gun assembly.

27. The beverage dispensing apparatus of claim 25 wherein the recirculation loop is located in the python near the bar gun assembly.

28. The beverage dispensing apparatus of claim 25 wherein the bar gun assembly includes a heel and a handle, and the recirculation loop is located in the heel of the bar gun assembly.

29. The beverage dispensing apparatus of claim 25 wherein the recirculation loop includes a substantially hollow "U"-shaped member adapted to route liquid coolant from the liquid coolant out line to the liquid coolant return line while maintaining the liquid coolant in a substantially liquid phase.

30. The beverage dispensing apparatus of claim 29 wherein the "U"-shaped member includes a pair of legs and a cross-piece joining the pair of legs, wherein a first leg of the pair of legs fluidly joins the out line and the second leg of the pair of legs fluidly joins the return line.

31. The beverage dispensing apparatus of claim 24 wherein the valve and manifold assembly is adapted to provide flow control to the liquid coolant being received at the first port.

32. The beverage dispensing apparatus of claim 24 further comprising:

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line.

33. The beverage dispensing apparatus of claim 25 wherein the python includes an outer sheath for substantially enclosing the python fluid lines therein.

34. The beverage dispensing apparatus of claim 25 further including a splitter adapted to divide the liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

35. A beverage dispensing apparatus comprising:

a bar gun assembly;

a valve and manifold assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and a manifold assembly liquid coolant return line;

a recirculation loop between the valve and manifold assembly and the bar gun assembly, the recirculation loop engaging the out and return liquid coolant lines of the valve and manifold assembly; and a bypass line located upstream of the first port and downstream of the second port, the bypass line diverting at least some of the liquid coolant away from the first port so that at least some of the liquid coolant does not pass through the valve and manifold assembly.

36. The beverage dispensing apparatus of claim 35 wherein the recirculation loop is adapted to route liquid coolant from the liquid coolant out line to the liquid coolant return line while maintaining the liquid coolant in a substantially liquid phase.

37. The beverage dispensing apparatus of claim 36 wherein the recirculation loop includes a substantially hollow "U"-shaped member adapted to route liquid coolant from the liquid coolant out line to the liquid coolant return line while maintaining the liquid coolant in a substantially liquid phase.

38. The beverage dispensing apparatus of claim 37 wherein the "U"-shaped member includes a pair of legs and a cross-piece joining the pair of legs, wherein a first leg of the pair of legs fluidly joins the out line and the second leg of the pair of legs fluidly joins the return line.

39. The beverage dispensing apparatus of claim 35 wherein the recirculation loop is located in the bar gun assembly.

40. The beverage dispensing apparatus of claim 35 wherein the recirculation loop is located in the python near the bar gun assembly.

41. The beverage dispensing apparatus of claim 35 wherein the bar gun assembly includes a heel and a handle, and the recirculation loop is located in the heel of the bar gun assembly.

42. The beverage dispensing apparatus of claim 35 wherein the valve and manifold assembly is adapted to provide flow control to the liquid coolant being received at the first port.

43. The beverage dispensing apparatus of claim 35 further comprising:

a trunk line carrying liquid coolant and circulating through a cooler;

a multiplicity of beverage concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line.

44. The beverage dispensing apparatus of claim 35 wherein the python includes an outer sheath substantially enclosing the python fluid lines therein.

45. The beverage dispensing apparatus of claim 35 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

46. A beverage dispensing apparatus comprising:

a bar gun assembly;

a valve and manifold assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, a python carrying a plurality of fluid lines engaging the valve and manifold assembly and extending toward the bar gun assembly, the fluid lines including a multiplicity of beverage concentrate carrying lines engaging the bar gun assembly and also including at least a valve and manifold assembly liquid coolant out line and a valve and a manifold assembly liquid coolant return line;

a recirculation loop between the valve and manifold assembly and the bar gun assembly, the recirculation loop engaging the out and return coolant lines of the valve and manifold assembly; and a splitter adapted to divide liquid coolant into at least two portions, wherein the splitter is coupled to the valve and manifold assembly to convey at least two of the portions thereto, one of the python fluid lines being adapted to carry a portion of the liquid coolant from the valve and manifold assembly to the bar gun assembly for dispensing therefrom, and the liquid coolant out line being adapted to carry another portion of the liquid coolant.

47. The beverage dispensing apparatus of claim 46 wherein the recirculation loop is located in the bar gun assembly.

48. The beverage dispensing apparatus of claim 46 wherein the recirculation loop is located in the python near the bar gun assembly.

49. The beverage dispensing apparatus of claim 46 wherein the bar gun assembly includes a heel and a handle, and the recirculation loop is located in the heel of the bar gun assembly.

50. The beverage dispensing apparatus of claim 46 wherein the recirculation loop is adapted to route liquid coolant from the liquid coolant out line to the liquid coolant return line while maintaining the liquid coolant in a substantially liquid phase.

51. The beverage dispensing apparatus of claim 50 wherein the recirculation loop includes a substantially hollow "U"-shaped member adapted to route liquid coolant from the liquid coolant out line to the liquid coolant return line while maintaining the liquid coolant in a substantially liquid phase.

52. The beverage dispensing apparatus of claim 51 wherein the "U"-shaped member includes a pair of legs and a cross-piece joining the pair of legs, wherein a first leg of the pair of legs fluidly joins the out line and the second leg of the pair of legs fluidly joins the return line.

53. The beverage dispensing apparatus of claim 46 further including a bypass line located upstream of the first port and downstream of the second port, the bypass line diverting at least some of the liquid coolant away from the first port so that at least some of the liquid coolant does not pass through the valve and manifold assembly.

54. The beverage dispensing apparatus of claim 46 wherein the valve and manifold assembly is adapted to provide flow control to the liquid coolant being received at the first port.

55. The beverage dispensing apparatus of claim 46 further comprising:

a trunk line carrying liquid coolant and circulating through a cooler;

a multiplicity of beverage concentrate bearing lines engaging a multiplicity of beverage concentrate sources to the beverage concentrate ports of the valve and manifold assembly;

an inline for carrying liquid coolant from the trunk line to the first port of the valve and manifold assembly; and an outline carrying liquid coolant from the second port of the valve and manifold assembly to the trunk line.

56. The beverage dispensing apparatus of claim 46 wherein the python includes an outer sheath for substantially enclosing the python fluid lines therein.

57. A beverage dispensing apparatus comprising:

a bar gun assembly;

a valve and manifold assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, the valve and manifold assembly adapted to provide flow control to the liquid coolant being received at the first port;

a trunk line carrying liquid coolant and circulating through a cooler;

a multiplicity of beverage concentrate bearing lines engaging a multiplicity of beverage concentrate sources to the beverage concentrate ports of the valve and manifold assembly;

an in line carrying liquid coolant from the trunk line to the first port of the valve and manifold assembly;

an out line carrying liquid coolant from the second port of the valve and manifold assembly to the trunk line;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and a manifold assembly liquid coolant return line; and a recirculation loop between the valve and manifold assembly and the bar gun assembly, the recirculation loop engaging the out and return liquid coolant lines of the valve and manifold assembly.

58. The beverage dispensing apparatus of claim 57 wherein the recirculation loop is adapted to route liquid coolant from the liquid coolant out line to the liquid coolant return line while maintaining the liquid coolant in a substantially liquid phase.

59. The beverage dispensing apparatus of claim 58 wherein the recirculation loop includes a substantially hollow "U"-shaped member adapted to route liquid coolant from the liquid coolant out line to the liquid coolant return line while maintaining the liquid coolant in a substantially liquid phase.

60. The beverage dispensing apparatus of claim 59 wherein the "U"-shaped member includes a pair of legs and a cross-piece joining the pair of legs, wherein a first leg of the pair of legs fluidly joins the out line and the second leg of the pair of legs fluidly joins the return line.

61. The beverage dispensing apparatus of claim 57 wherein the recirculation loop is located in the bar gun assembly.

62. The beverage dispensing apparatus of claim 57 wherein the recirculation loop is located in the python near the bar gun assembly.

63. The beverage dispensing apparatus of claim 57 wherein the bar gun assembly includes a heel and a handle, and the recirculation loop is located in the heel of the bar gun assembly.

64. The beverage dispensing apparatus of claim 57 wherein the python includes an outer sheath substantially enclosing the python fluid lines therein.

65. The beverage dispensing apparatus of claim 57 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

66. The beverage dispensing apparatus of claim 57 further including a bypass line located upstream of the first port and downstream of the second port, the bypass line diverting at least some of the liquid coolant away from the first port so that at least some of the liquid coolant does not pass through the valve and manifold assembly.

67. A beverage dispensing apparatus comprising:

a bar gun assembly;

a valve and manifold assembly, the assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line;

a bypass line located upstream of the first port and downstream of the second port, the bypass line diverting at least some of the liquid coolant away from the first port so that at least some of the liquid coolant does not pass through the valve and manifold assembly; and a recirculation loop in the bar gun assembly, the recirculation loop engaging the out and return liquid coolant lines of the valve and manifold assembly and adapted to route liquid coolant from the liquid coolant out line to the liquid coolant return line while maintaining the liquid coolant in a substantially liquid phase.

68. The beverage dispensing apparatus of claim 67 wherein the bar gun assembly includes a heel and a handle, and the recirculation loop is located in the heel of the bar gun assembly.

69. The beverage dispensing apparatus of claim 67 wherein the valve and manifold assembly is adapted to provide flow control to the liquid coolant being received at the first port.

70. The beverage dispensing apparatus of claim 67 further comprising:

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line for carrying liquid coolant from the trunk line to the first port of the valve and manifold assembly; and an out line carrying liquid coolant from the second port of the valve and manifold assembly to the trunk line.

71. The beverage dispensing apparatus of claim 67 wherein the python includes an outer sheath substantially enclosing the python fluid lines therein.

72. The beverage dispensing apparatus of claim 67 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

73. A beverage dispensing apparatus comprising:

a bar gun assembly;

a valve and manifold assembly, the assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line;

a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant; and a recirculation loop between the valve and manifold assembly and the bar gun assembly, the recirculation loop engaging the out and return liquid coolant lines of the valve and manifold assembly and adapted to route liquid coolant from the liquid coolant out line to the liquid coolant return line while maintaining the liquid coolant in a substantially liquid phase.

74. The beverage dispensing apparatus of claim 73 wherein the recirculation loop is located in the bar gun assembly.

75. The beverage dispensing apparatus of claim 73 wherein the recirculation loop is located in the python near the bar gun assembly.

76. The beverage dispensing apparatus of claim 73 wherein the bar gun assembly includes a heel and a handle, and the recirculation loop is located in the heel of the bar gun assembly.

77. The beverage dispensing apparatus of claim 73 wherein the recirculation loop includes a substantially hollow "U"-shaped member adapted to route liquid coolant from the liquid coolant out line to the liquid coolant return line while maintaining the liquid coolant in a substantially liquid phase.

78. The beverage dispensing apparatus of claim 77 wherein the "U"-shaped member includes a pair of legs and a cross-piece joining the pair of legs, wherein a first leg of the pair of legs fluidly joins the out line and the second leg of the pair of legs fluidly joins the return line.

79. The beverage dispensing apparatus of claim 73 further including a bypass line located upstream of the first port and downstream of the second port, the bypass line diverting at least some of the liquid coolant away from the first port so that at least some of the coolant does not pass through the valve and manifold assembly.

80. The beverage dispensing apparatus of claim 79 wherein the recirculation loop is located in the bar gun assembly.

81. The beverage dispensing apparatus of claim 79 wherein the recirculation loop is located in the python near the bar gun assembly.

82. The beverage dispensing apparatus of claim 79 wherein the bar gun assembly includes a heel and a handle, and the recirculation loop is located in the heel of the bar gun assembly.

83. The beverage dispensing apparatus of claim 73 wherein the valve and manifold assembly is adapted to provide flow control to the liquid coolant being received at the first port.

84. The beverage dispensing apparatus of claim 73 further comprising:

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line for carrying liquid coolant from the trunk line to the first port of the valve and manifold assembly; and an out line carrying liquid coolant from the second port of the valve and manifold assembly to the trunk line.

85. The beverage dispensing apparatus of claim 73 wherein the python includes an outer sheath substantially enclosing the python fluid lines therein.

86. A beverage dispensing apparatus comprising:

a valve and manifold assembly, the assembly including:

a first port to receive a liquid coolant from a source, a second port to emit the liquid coolant into a python fluid line, a third port to receive the liquid coolant from a python fluid line, a fourth port to emit the liquid coolant back towards the source, and a multiplicity of ports to receive beverage concentrates, and a multiplicity of flow control elements for controlling the flow of fluid therethrough;

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line.

87. The beverage dispensing apparatus of claim 86, further comprising:

a bar gun assembly;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line; and a recirculation loop between the valve and manifold assembly and the bar gun assembly, the recirculation loop engaging the out and return liquid coolant lines of the valve and manifold assembly and adapted to route the liquid coolant from the liquid coolant out line to the liquid coolant return line while maintaining the liquid coolant in a substantially liquid phase.

88. The beverage dispensing apparatus of claim 87 wherein the recirculation loop is located in the bar gun assembly.

89. The beverage dispensing apparatus of claim 87 wherein the recirculation loop is located in the python near the bar gun assembly.

90. The beverage dispensing apparatus of claim 87 wherein the bar gun assembly includes a heel and a handle, and the recirculation loop is located in the heel of the bar gun assembly.

91. The beverage dispensing apparatus of claim 87 wherein the recirculation loop includes a substantially hollow "U"-shaped member adapted to route liquid coolant from the liquid coolant out line to the liquid coolant return line while maintaining the liquid coolant in a substantially liquid phase.

92. The beverage dispensing apparatus of claim 91 wherein the "U"-shaped member includes a pair of legs and a cross-piece joining the pair of legs, wherein a first leg of the pair of legs fluidly joins the out line and the second leg of the pair of legs fluidly joins the return line.

93. The beverage dispensing apparatus of claim 87 further including a bypass line located upstream of the first port and downstream of the second port, the bypass line diverting at least some of the liquid coolant so that at least some of the liquid coolant does not pass through the valve and manifold assembly.

94. The beverage dispensing apparatus of claim 87 wherein the valve and manifold assembly is adapted to provide flow control to the liquid coolant being received at the first port.

95. The beverage dispensing apparatus of claim 87 wherein the python includes an outer sheath for substantially enclosing the python fluid lines therein.

96. The beverage dispensing apparatus of claim 87 further including a splitter adapted to divide the liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

97. A beverage dispensing apparatus comprising:

a valve and manifold assembly, the assembly including:

a first port to receive a liquid coolant from a source, a second port to emit the liquid coolant into a python fluid line, a third port to receive the liquid coolant from a python fluid line, a fourth port to emit the liquid coolant back towards the source, and a multiplicity of ports to receive beverage concentrates, and a multiplicity of flow control elements for controlling the flow of fluid therethrough; and a splitter adapted to divide the liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

98. The beverage dispensing apparatus of claim 97, further comprising:

a bar gun assembly;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line; and a recirculation loop between the valve and manifold assembly and the bar gun assembly, the recirculation loop engaging the out and return liquid coolant lines of the valve and manifold assembly and adapted to route the liquid coolant from the liquid coolant out line to the liquid coolant return line while maintaining the liquid coolant in a substantially liquid phase.

99. The beverage dispensing apparatus of claim 98 wherein the recirculation loop is located in the bar gun assembly.

100. The beverage dispensing apparatus of claim 98 wherein the recirculation loop is located in the python near the bar gun assembly.

101. The beverage dispensing apparatus of claim 98 wherein the bar gun assembly includes a heel and a handle, and the recirculation loop is located in the heel of the bar gun assembly.

102. The beverage dispensing apparatus of claim 98 wherein the recirculation loop includes a substantially hollow "U"-shaped member adapted to route liquid coolant from the liquid coolant out line to the liquid coolant return line while maintaining the liquid coolant in a substantially liquid phase.

103. The beverage dispensing apparatus of claim 102 wherein the "U"-shaped member includes a pair of legs and a cross-piece joining the pair of legs, wherein a first leg of the pair of legs fluidly joins the out line and the second leg of the pair of legs fluidly joins the return line.

104. The beverage dispensing apparatus of claim 97 further including a bypass line located upstream of the first port and downstream of the second port, the bypass line diverting at least some of the liquid coolant so that at least some of the liquid coolant does not pass through the valve and manifold assembly.

105. The beverage dispensing apparatus of claim 97 wherein the valve and manifold assembly is adapted to provide flow control to the liquid coolant being received at the first port.

106. The beverage dispensing apparatus of claim 97 further comprising:

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line.

107. The beverage dispensing apparatus of claim 98 wherein the python includes an outer sheath for substantially enclosing the python fluid lines therein.

108. A beverage dispensing apparatus comprising:

a bar gun assembly;

a valve and manifold assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, the valve and manifold assembly adapted to provide flow control to the liquid coolant being received at the first port;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and a manifold assembly liquid coolant return line a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant; and a recirculation loop between the valve and manifold assembly and the bar gun assembly, the recirculation loop engaging the out and return liquid coolant lines of the valve and manifold assembly.

109. The beverage dispensing apparatus of claim 108 wherein the recirculation loop is adapted to route liquid coolant from the liquid coolant out line to the liquid coolant return line while maintaining the liquid coolant in a substantially liquid phase.

110. The beverage dispensing apparatus of claim 109 wherein the recirculation loop includes a substantially hollow "U"-shaped member adapted to route liquid coolant from the liquid coolant out line to the liquid coolant return line while maintaining the liquid coolant in a substantially liquid phase.

111. The beverage dispensing apparatus of claim 110 wherein the "U"-shaped member includes a pair of legs and a cross-piece joining the pair of legs, wherein a first leg of the pair of legs fluidly joins the out line and the second leg of the pair of legs fluidly joins the return line.

112. The beverage dispensing apparatus of claim 108 wherein the recirculation loop is located in the bar gun assembly.

113. The beverage dispensing apparatus of claim 108 wherein the recirculation loop is located in the python near the bar gun assembly.

114. The beverage dispensing apparatus of claim 108 wherein the bar gun assembly includes a heel and a handle, and the recirculation loop is located in the heel of the bar gun assembly.

115. The beverage dispensing apparatus of claim 108 further comprising:

a trunk line carrying liquid coolant and circulating through a cooler;

a multiplicity of beverage concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line.

116. The beverage dispensing apparatus of claim 108 wherein the python includes an outer sheath substantially enclosing the python fluid lines therein.

117. The beverage dispensing apparatus of claim 108 further including a bypass line located upstream of the first port and downstream of the second port, the bypass line diverting at least some of the liquid coolant away from the first port so that at least some of the liquid coolant does not pass through the valve and manifold assembly.

118. A beverage dispensing apparatus comprising:

a bar gun assembly;

a valve and manifold assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, the valve and manifold assembly adapted to provide flow control to the liquid coolant being received at the first port;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and a manifold assembly liquid coolant return line;

a bypass line located upstream of the first port and downstream of the second port, the bypass line diverting at least some of the liquid coolant away from the first port so that at least some of the liquid coolant does not pass through the valve and manifold assembly; and a recirculation loop between the valve and manifold assembly and the bar gun assembly, the recirculation loop engaging the out and return liquid coolant lines of the valve and manifold assembly.

119. The beverage dispensing apparatus of claim 118 wherein the recirculation loop is adapted to route liquid coolant from the liquid coolant out line to the liquid coolant return line while maintaining the liquid coolant in a substantially liquid phase.

120. The beverage dispensing apparatus of claim 119 wherein the recirculation loop includes a substantially hollow "U"-shaped member adapted to route liquid coolant from the liquid coolant out line to the liquid coolant return line while maintaining the liquid coolant in a substantially liquid phase.

121. The beverage dispensing apparatus of claim 120 wherein the "U"-shaped member includes a pair of legs and a cross-piece joining the pair of legs, wherein a first leg of the pair of legs fluidly joins the out line and the second leg of the pair of legs fluidly joins the return line.

122. The beverage dispensing apparatus of claim 118 wherein the recirculation loop is located in the bar gun assembly.

123. The beverage dispensing apparatus of claim 118 wherein the recirculation loop is located in the python near the bar gun assembly.

124. The beverage dispensing apparatus of claim 118 wherein the bar gun assembly includes a heel and a handle, and the recirculation loop is located in the heel of the bar gun assembly.

125. The beverage dispensing apparatus of claim 118 further comprising:

a trunk line carrying liquid coolant and circulating through a cooler;

a multiplicity of beverage concentrate bearing lines engaging a multiplicity of beverage concentrate sources to the beverage concentrate ports of the valve and manifold assembly;

an in line carrying liquid coolant from the trunk line to the first port of the valve and manifold assembly; and an out line carrying liquid coolant from the second port of the valve and manifold assembly to the trunk line.

126. The beverage dispensing apparatus of claim 118 wherein the python includes an outer sheath substantially enclosing the python fluid lines therein.

127. The beverage dispensing apparatus of claim 118 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

128. A beverage dispensing apparatus comprising:

a bar gun assembly;

a valve and manifold assembly, the assembly including:

a first port to receive liquid coolant from a source, a second port to emit the liquid coolant back towards the source, a multiplicity of ports to receive beverage concentrates, and a multiplicity of flow control elements for controlling the flow of fluid therethrough;

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line for carrying liquid coolant from the trunk line to the first port of the valve and manifold assembly; and an out line carrying liquid coolant from the second port of the valve and manifold assembly to the trunk line;

a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line; and a recirculation loop in the bar gun assembly, the recirculation loop engaging the out and return liquid coolant lines of the valve and manifold assembly and adapted to route liquid coolant from the liquid coolant out line to the liquid coolant return line while maintaining the liquid coolant in a substantially liquid phase.

129. The beverage dispensing apparatus of claim 128 wherein the bar gun assembly includes a heel and a handle, and the recirculation loop is located in the heel of the bar gun assembly.

130. The beverage dispensing apparatus of claim 128 further including a bypass line located upstream of the first port and downstream of the second port, the bypass line diverting at least some of the liquid coolant away from the first port so that at least some of the liquid coolant does not pass through the valve and manifold assembly.

131. The beverage dispensing apparatus of claim 128 wherein the valve and manifold assembly is adapted to provide flow control to the liquid coolant being received at the first port.

132. The beverage dispensing apparatus of claim 128 wherein the python includes an outer sheath substantially enclosing the python fluid lines therein.

133. The beverage dispensing apparatus of claim 128 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

134. A beverage dispensing apparatus comprising:

a bar gun assembly;

a valve and manifold assembly, the assembly including:

a first port to receive liquid coolant from a source, a second port to emit the liquid coolant back towards the source, a multiplicity of ports to receive beverage concentrates, and a multiplicity of flow control elements for controlling the flow of fluid therethrough, a python carrying a plurality of fluid lines engaging the valve and manifold assembly and extending towards the bar gun assembly, the fluid lines including a multiplicity of beverage concentrate carrying lines engaging the bar gun assembly and also including at least a valve and manifold assembly liquid coolant out line and a valve and manifold assembly liquid coolant return line;

a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant; and a recirculation loop in the bar gun assembly, the recirculation loop engaging the out and return liquid coolant lines of the valve and manifold assembly and adapted to route liquid coolant from the liquid coolant out line to the liquid coolant return line while maintaining the liquid coolant in a substantially liquid phase.

135. The beverage dispensing apparatus of claim 134 further including a splitter adapted to divide liquid coolant into at least two portions, wherein the splitter is coupled to the valve and manifold assembly to convey at least two of the portions thereto, one of the python lines being adapted to carry a portion of the liquid coolant from the valve and manifold assembly to the bar gun assembly for dispensing therefrom, and the liquid coolant out line being adapted to carry another portion of the liquid coolant.

136. The beverage dispensing apparatus of claim 134 wherein the bar gun assembly includes a heel and a handle, and the recirculation loop is located in the heel of the bar gun assembly.

137. The beverage dispensing apparatus of claim 134 further including a bypass line located upstream of the first port and downstream of the second port, the bypass line diverting at least some of the liquid coolant away from the first port so that at least some of the liquid coolant does not pass through the valve and manifold assembly.

138. The beverage dispensing apparatus of claim 134 wherein the valve and manifold assembly is adapted to provide flow control to the liquid coolant being received at the first port.

139. The beverage dispensing apparatus of claim 134 further comprising:

a trunk line carrying liquid coolant and circulating through a cooler;

a multiplicity of liquid concentrate bearing lines engaging a multiplicity of beverage concentrate sources to the beverage concentrate ports of the valve and manifold assembly;

an in line for carrying liquid coolant from the trunk line to the first port of the valve and manifold assembly; and an out line carrying liquid coolant from the second port of the valve and manifold assembly to the trunk line.

140. The beverage dispensing apparatus of claim 134 wherein the python includes an outer sheath substantially enclosing the python fluid lines therein.

* * * * *